US005722207A

United States Patent [19]

Anderson et al.

[11] Patent Number: 5,722,207

[45] Date of Patent: Mar. 3, 1998

[54] FOLDABLE NAIL FIN

[75] Inventors: Craig A. Anderson; James T. Grigsby, both of Lincoln, Nebr.

[73] Assignee: SealRite Windows, Inc., Lincoln, Nebr.

[21] Appl. No.: 239,334

[22] Filed: May 6, 1994

[51] Int. Cl.[6] ..... E06B 3/00

[52] U.S. Cl. ..... 52/204.55; 52/213

[58] Field of Search ..... 52/204.55, 214, 52/211, 213, 586.1, 714

[56] References Cited

U.S. PATENT DOCUMENTS

| | | | |
|---|---|---|---|
| 3,336,698 | 8/1967 | MacGregor | 49/380 |
| 4,821,472 | 4/1989 | Tix | 52/213 |
| 4,999,957 | 3/1991 | Kessler | 52/213 |
| 5,077,939 | 1/1992 | Erickson | 49/380 |
| 5,210,986 | 5/1993 | Hagemeyer et al. | 52/211 |

FOREIGN PATENT DOCUMENTS 248761 12/1962 Australia .

*Primary Examiner*—Creighton Smith
*Attorney, Agent, or Firm*—Zarley, McKee, Thomte Voorhees & Sease; Dennis L. Thomte

[57] ABSTRACT

A foldable nail fin for a window comprising an inner end which is normally positioned in a kerf formed in the window frame. The nail fin is normally positioned in a substantially flush condition with respect to the window frame. At the building site, the nail fin may be folded from its substantially flush position to an outwardly extending position so that the nail fin may be secured to a building surface extending around a window opening formed therein. The folding of the nail fin is enhanced through the use of a fold line formed in the nail fin which is located closely adjacent the inner end thereof.

1 Claim, 3 Drawing Sheets

FOLDABLE NAIL FIN

BACKGROUND OF THE INVENTION

1. Field of the Invention

This invention relates to a nail fin which is secured to a window frame and more particularly to a foldable nail fin which is positioned in a flush position for shipment to the building site but which may be folded to an outwardly extending position for nailing to a building surface extending around a window opening created therein.

2. Description of the Prior Art

Windows are normally installed in an opening created in a building surface by either nailing the brick molding of the window to the building surface or by nailing the nail fin of the window to the building surface. In those windows which have a nail fin, the nail fins are normally installed on the window frame at the factory and extend outwardly from the window frame. The outwardly extending nail fins of the conventional windows make it somewhat difficult to ship the window frame from the factory to the building site due to the increased height and width of the window. The conventional nail fins do not allow the windows to stand by themselves, unaided. They require special blocking or packaging, or must be leaned against a support. Further, the conventional nail fins are frequently damaged during shipment. Yet another disadvantage of the conventional nail fins is that carpenters are frequently injured when handling the nail fins due to the protruding portions thereof and the sharp surfaces thereon.

SUMMARY OF THE INVENTION

A foldable nail fin is described for use on a window having a frame extending therearound. Conventional clad windows normally have a kerf formed therein into which the conventional nail fins are inserted. In the instant invention, each of the nail fins is foldable and has inner and outer ends. The inner end of the nail fin is received in the kerf in the window and is folded in a substantially flush condition with respect to the window frame for transport to the building site. When it is desired to install the window in an opening created in a building surface, the nail fins on the window are folded from their normally flush position to a position wherein they extend outwardly from the window frame for nailing to the building surface. The folding action of the nail fin is enhanced by creating a fold line therein adjacent the inner end thereof.

It is therefore a principal object of the invention to provide a folding nail fin for a window.

Still another object of the invention is to provide a folding nail fin for a window wherein the nail fin is normally positioned in a substantially flush relationship with respect to the window frame for handling and shipment purposes but which may be easily folded outwardly at the building site for nailing purposes.

Still another object of the invention is to provide a folding nail fin for a window including a fold line formed therein for enhancing the folding movement of the nail fin.

Still another object of the invention is to provide a folding nail fin for a window wherein the outer end of the nail fin is folded upon itself to present a relatively blunt surface.

It is yet a further object of the invention to provide a nail fin for a window which is economical of manufacture, durable in use and refined in appearance.

These and other objects will be apparent to those skilled in the art.

DESCRIPTION OF THE PREFERRED EMBODIMENT

Figure 2:
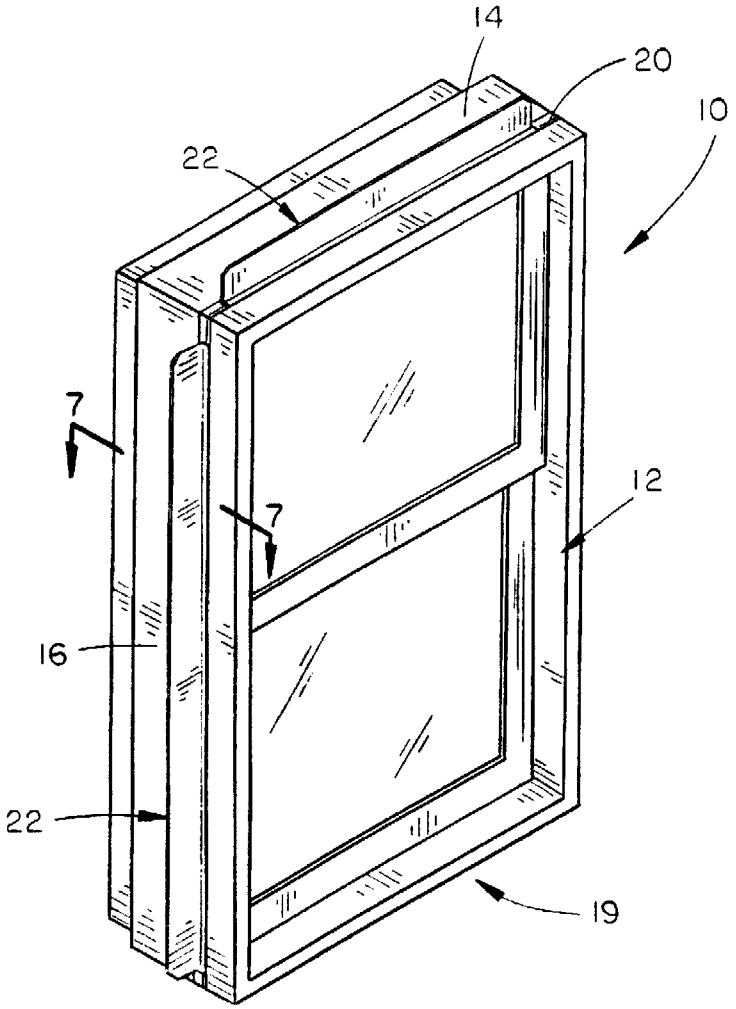
FIG. 2 is a view similar to FIG. 1 except that the nail fins have been folded from their folded position to an installation position.

The numeral 10 refers to a conventional window having a frame 12 extending therearound. Frame 12 includes a head or head jamb 14, side jambs 16 and 18 and sill 19. In the window illustrated in the drawings, the outer portion of the window is clad with a aluminum material in conventional fashion.

A kerf 20 is provided in the head jamb 14, side jambs 16 and 18 and the sill 19. An elongated, metal nail fin 22 is positioned in each of the kerfs 20 as will now be described. Inasmuch as each of the nail fins are identical, only a single nail fin will be described.

Nail fin 22 includes an inner end 24 which is folded upon itself to form a V-shape. The inner end 24 of the nail fin 22 is frictionally inserted into the kerf 20 and is maintained therein due to the resilient nature of the V-shaped inner end and the biting action of the edge 25.

Figure 3:
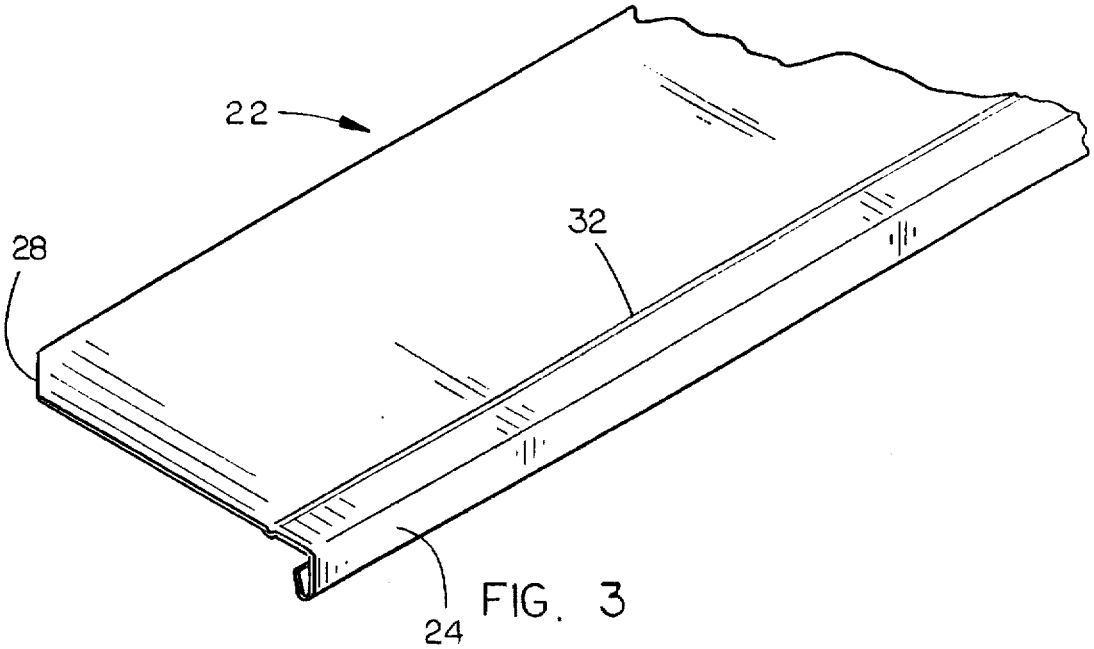
FIG. 3 is a perspective view of the nail fin of this invention.
Figure 4:
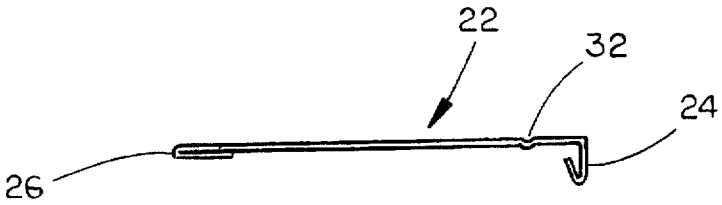
FIG. 4 is an end view of the nail fin of this invention.
Figure 5:
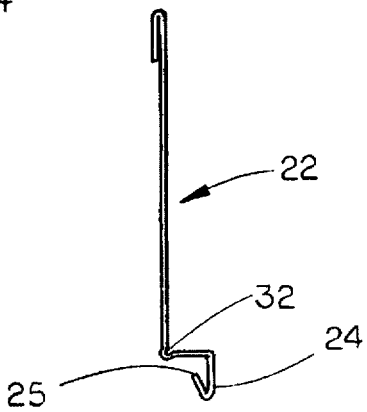
FIG. 5 is an end view of the nail fin of this invention after it has been folded to its installation position.

The outer end 26 of nail fin 22 is folded upon itself as illustrated in FIG. 4 to provide a relatively blunt surface to prevent carpenters from injuring themselves on the otherwise sharp outer end of the nail fin. Further, the outer ends of the nail fin 22 are notched at 28 and 30 to eliminate an otherwise pointed or sharp corner surface. Nail fin 22 is provided with a fold line 32 formed therein which extends inwardly thereinto from one end to the other as illustrated in FIGS. 3 and 4.

Figure 1:
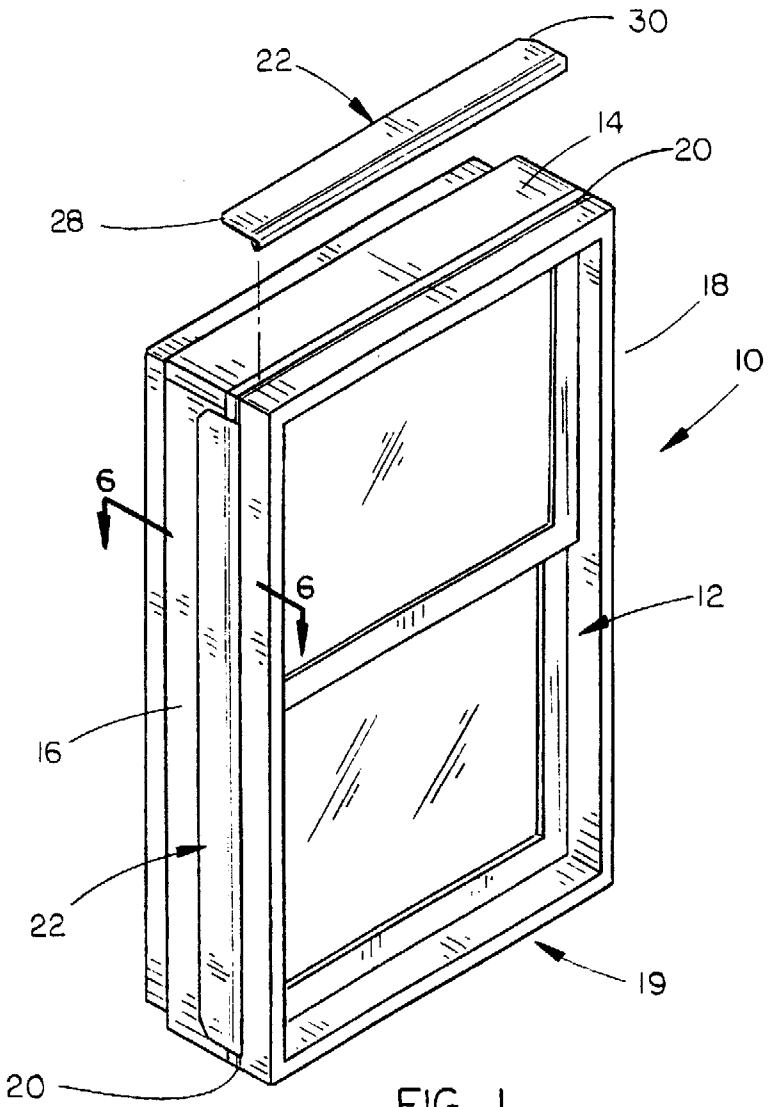
FIG. 1 is a perspective view of a window having the nail fins of this invention mounted thereon.

After the window 10 is manufactured, a plurality of the nail fins 22 are installed on the window frame by inserting the inner ends thereof into the kerfs 20 as described. As seen in FIG. 1, when the nail fins 22 are first installed on the window for shipment purposes, the nail fin 22 is positioned in a flush relationship with respect to the window. Thus, the window can be shipped from the factory to the building site in a convenient manner because the nail fins 22 do not protrude outwardly from the window frame as is the conventional practice. The fact that the nail fins 22 are folded into a substantially flush position during transport prevents the nail fins from becoming damaged during shipment.

Figure 7:
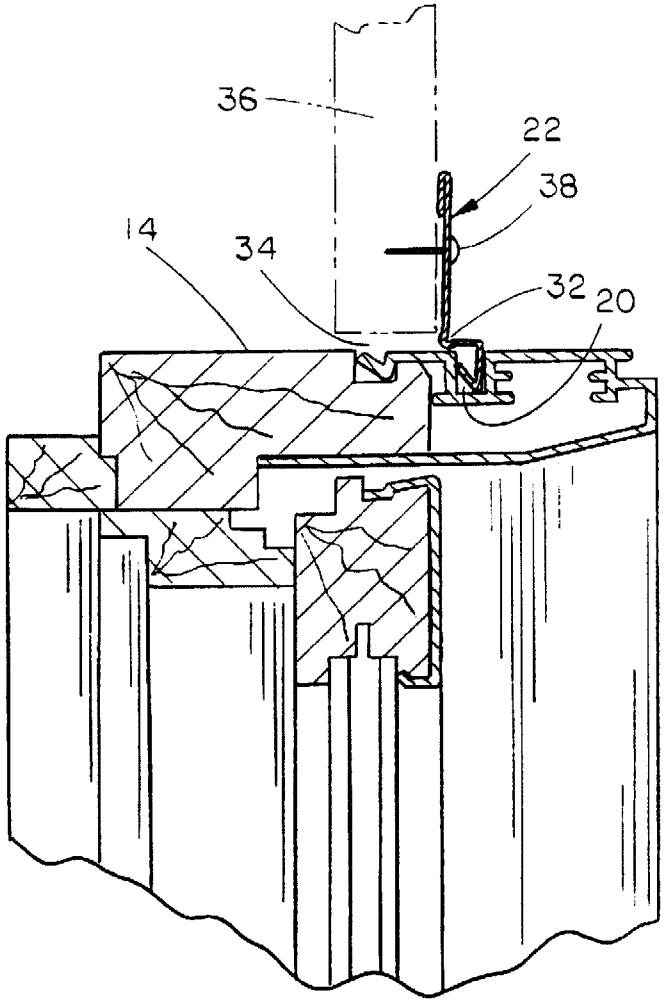
FIG. 7 is a view similar to FIG. 6 except that the nail fin has been folded to its installation position.
Figure 6:
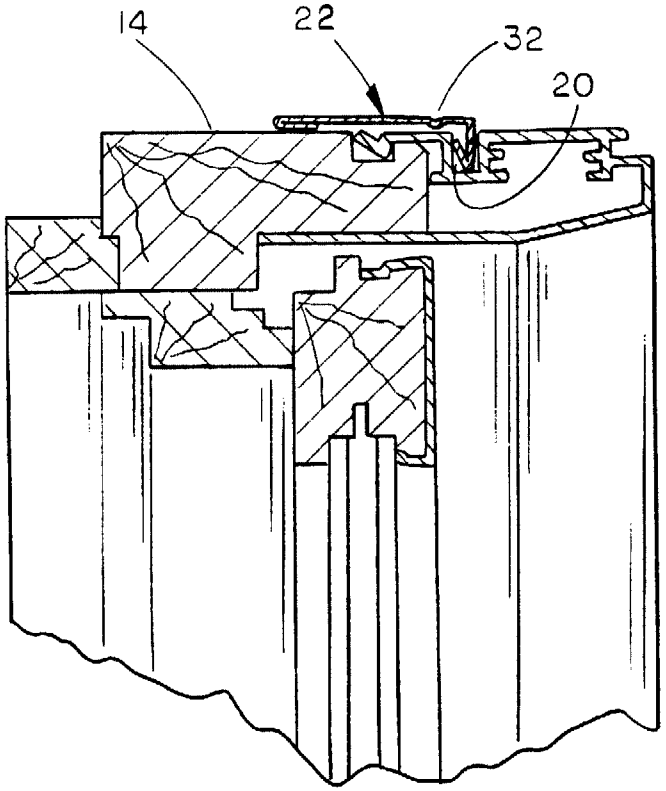
FIG. 6 is a partial sectional view of a window frame having the nail fin of this invention mounted thereon in its folded condition.

When the window arrives at the job or building site and it is desired to mount the window 10 in an opening 34 in a building surface 36, each of the nail fins 22 are folded from their flush position illustrated in FIG. 6 to the outwardly extending position illustrated in FIG. 7. The outward folding of the nail fins is enhanced through the use of the fold line 32. Once the nail fins 22 have been folded from the position of FIG. 6 to the position of FIG. 7, the window 10 may be mounted in the opening 32 and nails 38 may be driven through the nail fins to properly mount the window 10 in the opening 34.

Thus it can be seen that a novel folding nail fin has been provided which enables the window to be shipped from the factory to the building site without fear that the nail fin will be damaged during handling or shipment or will otherwise pose a problem to the shipment thereof. Once at the building site, the nail fins are easily and conveniently folded from the position of FIG. 6 to the position of FIG. 7 so that the nail fins may be conveniently and conventionally secured to the building surface 36.

Preferably, the nail fins 22 are comprised of a metal material although it may be possible to utilize materials other than metal. However, as stated, it is preferred that the nail fin 22 be comprised of a metal material since it is believed that a metal nail fin will be more durable and will not break during the folding operation.

Thus it can be seen that the nail fin of this invention accomplishes at least all of its stated objectives.

We claim:

1. In combination:

a window including a frame;

said frame having a kerf formed therein;

and at least one foldable metal nail fin operatively secured to said frame;

said nail fin comprising a substantially flat body portion and an inner end portion which extends transversely from said body portion for insertion into said kerf whereby said body portion is normally positioned flush against said frame without objectionably protruding therefrom so that said frame and said nail fin may be shipped to a building site; said body portion of said nail fin having an indented fold line formed therein adjacent said inner end portion so that said body portion may be selectively folded, about said fold line, from its normally flush position adjacent said frame to a position wherein said nail fin extends outwardly from said window frame for nailing to a building surface extending around a window opening created therein;

the metal construction of said nail fin causing said nail fin to remain in its said flush position until manually folded outwardly to its nailing position;

the metal construction of said nail fin causing said nail fin to remain in its nailing position after it has been folded outwardly thereto.

* * * * *